US007146778B2

(12) United States Patent
Loibl

(10) Patent No.: US 7,146,778 B2
(45) Date of Patent: Dec. 12, 2006

(54) APPARATUS FOR PRODUCING PACKAGING AIR-CUSHION ELEMENTS

(75) Inventor: Bernd Loibl, Klettgau (DE)

(73) Assignee: Lupoki Development GmbH, Klettgau (DE)

( * ) Notice: Subject to any disclaimer, the term of this patent is extended or adjusted under 35 U.S.C. 154(b) by 27 days.

(21) Appl. No.: 11/087,718

(22) Filed: Mar. 24, 2005

(65) Prior Publication Data

US 2006/0213147 A1 Sep. 28, 2006

(51) Int. Cl.
*B65B 31/00* (2006.01)

(52) U.S. Cl. ..... 53/79; 53/547

(58) Field of Classification Search ..... 53/403, 53/79, 545, 547; 493/967
See application file for complete search history.

(56) References Cited

U.S. PATENT DOCUMENTS 3,817,803 A * 6/1974 Horsky ..... 156/85
3,938,298 A * 2/1976 Luhman et al. ..... 53/403
5,216,868 A 6/1993 Cooper et al.
5,937,614 A * 8/1999 Watkins et al. ..... 53/79
6,375,785 B1 4/2002 Aquarius
6,789,376 B1 * 9/2004 Greenwood et al. ..... 53/79
6,948,296 B1 * 9/2005 Lerner et al. ..... 493/967
6,952,910 B1 * 10/2005 Lorsch ..... 53/79

FOREIGN PATENT DOCUMENTS

EP 0 836 928 A 4/1998
EP 1044793 10/2000
FR 2679168 1/1993

* cited by examiner

*Primary Examiner*—Louis Huynh
(74) *Attorney, Agent, or Firm*—Browdy and Neimark, PLLC

(57) ABSTRACT

An apparatus for producing air-cushion elements comprises at least one supply roll (1) of plastic film material (9), a cutting device (21) for cutting at least one opening into the plastic film material, which is double-layered in the apparatus, a blower (29) for blowing air through the opening, a closing device (23, 24) for sealing the air in the plastic film material to form an air-cushion element, and a cam disc (10) having a series of raised guide ribs (11–17) that are in direct actuation contact with and drive the cutting device and the closing device.

6 Claims, 5 Drawing Sheets

APPARATUS FOR PRODUCING PACKAGING AIR-CUSHION ELEMENTS

FIELD OF THE INVENTION

The invention relates to an apparatus for producing packaging air-cushion elements having at least one supply roll of laminatable plastic film material that is feedable in at least one length to the apparatus, comprising a cutting means for cutting at least one opening into the plastic film material, which is double-layered in the apparatus, comprising a blower whereby air is blowable through said opening into the plastic film material, and comprising closing means for creating a sealed air cushion from the plastic film material. Apparatuses of this type are customary in industry to securely package sensitive objects. These apparatuses use, for example, as described in EP 1 044 793, an unwindable film tube into which a perforation means cuts a line of perforations in order to subsequently blow air into the film tube.

DESCRIPTION OF THE PRIOR ART

FR 2,679,168 does not use a float for opening the tube halves but utilizes the force of the airflow itself to open the tube halves. U.S. Pat. No. 5,216,868 shows an apparatus for producing packaging air-cushion elements comprising a cam shaft with which various stations can be controlled. A cam controls a sealing element for a first step, during which air is blown into a certain length of tube. A multitude of additional work stations are lowered in a second step onto the inflated tube in order to create, by means of a welding process, individual air cushions.

SUMMARY OF THE INVENTION

With this prior art as the starting point, the invention is based on the object of making available the above-mentioned industrial packaging methods also in small-series production and by the simplest means possible to virtually any interested business.

This object is met according to the invention for an apparatus of the type mentioned at the beginning.

Because a cam disc is provided, the various mechanical operations can be actuated in a very easy manner. At the same time, also the electrical actuation control is performed here by mechanical means in a very safe manner.

If the cutting blade has a convex shape or arrow shape, a commercially available cutting blade may be used, which can, moreover, be easily exchanged by the user himself, which greatly increases the ease of maintenance of the apparatus.

In this manner a very simple apparatus of this type for the production of air cushions has been created, in which, moreover, a simple cutting blade can be used, which is also exchangeable in a simple manner.

BRIEF DESCRIPTION OF THE DRAWINGS

An example embodiment of the invention will now be explained in more detail, based on the drawings, in which.

DETAILED DESCRIPTION OF THE DRAWINGS

Figure 1:
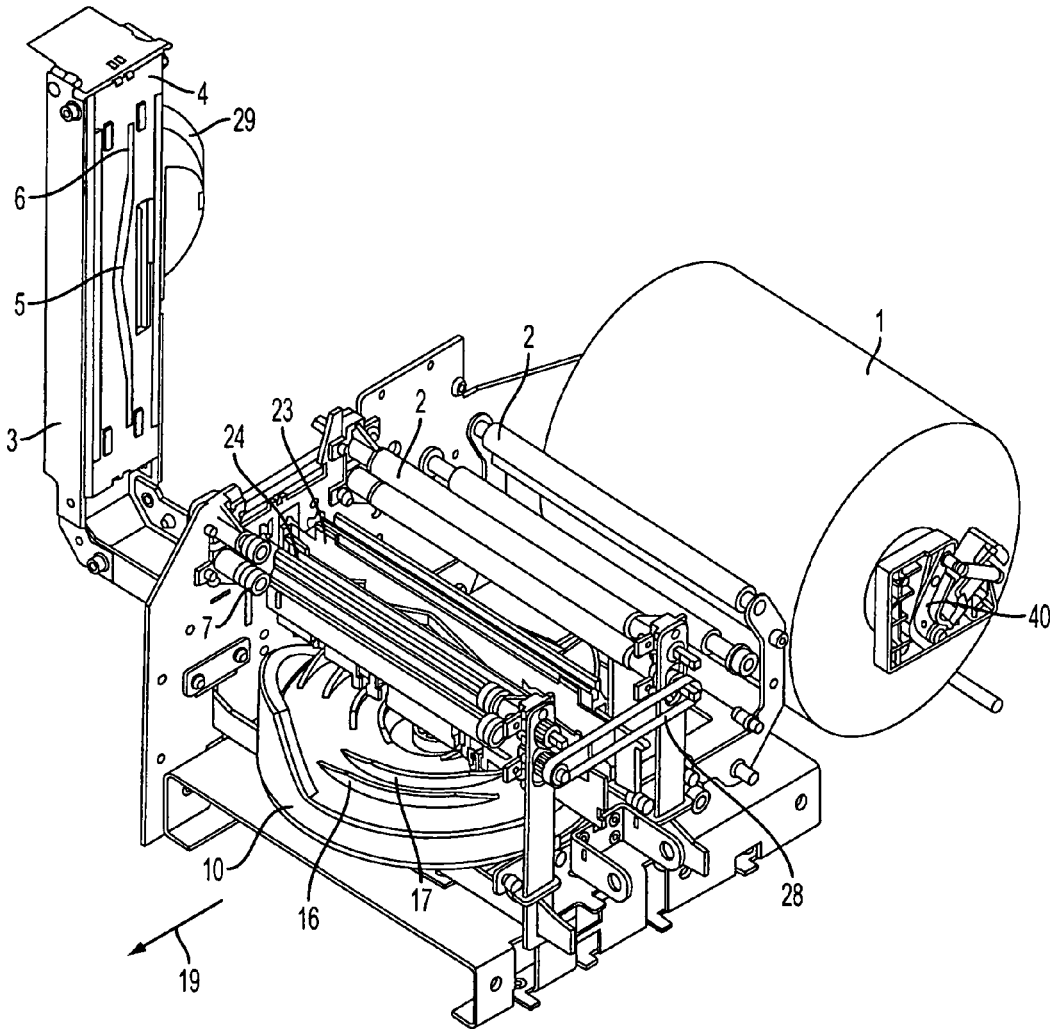
FIG. 1 is a perspective view of an example embodiment of the invention.

FIG. 1 shows a perspective view of the example embodiment of the invention. The apparatus for producing packaging air cushions is supplied from a supply roll 1, from which a tube is guided over a multitude of guide rollers and film tensioners 2 into a processing area. This processing area is being closed off by means of a hinged blower terminal 3, which is designed on its underside 4 as a matrix for the various processing elements. The blower terminal 3 specifically incorporates on its underside an arrow-shaped slit 5, whose tip is oriented toward the direction of movement of the film material 1. The legs of the arrow of the slit 5 are highly obtuse and transition, in their end regions 6, into perforation-slit regions extending perpendicular to said direction of movement of the film. The processed film is released from the apparatus by means of output rollers, which are represented here only by the bearings 7, in such a way that the change in shape of the flat film into the air cushion takes place on the other side of the rollers 7 in the direction of movement 19 of the film. The rollers 2 and 7 may be connected to each other by means of a toothed belt 28, which makes it possible, in particular, that a single motor, which is not shown in the figures, can accomplish the advancement of the film.

The processing elements explained in connection with FIGS. 3 through 6 are controlled by means of a cam disc 10 whose base is disposed parallel to the plane of film 9 passing above it. The blower terminal 3 has an extension piece 29, that is connectable to a blower not shown in the figure. Through the extension piece 29, air is blown between the film layers through the blower terminal 3 and the blade openings 5/6 that are located there and through the blower opening 25, as will be explained in more detail below. It should be noted at this time already that a second motor, which is also not shown in the figures, is used here below the disc 10, whereby the entire apparatus is drivable and controllable with altogether two motors.

Figure 2:
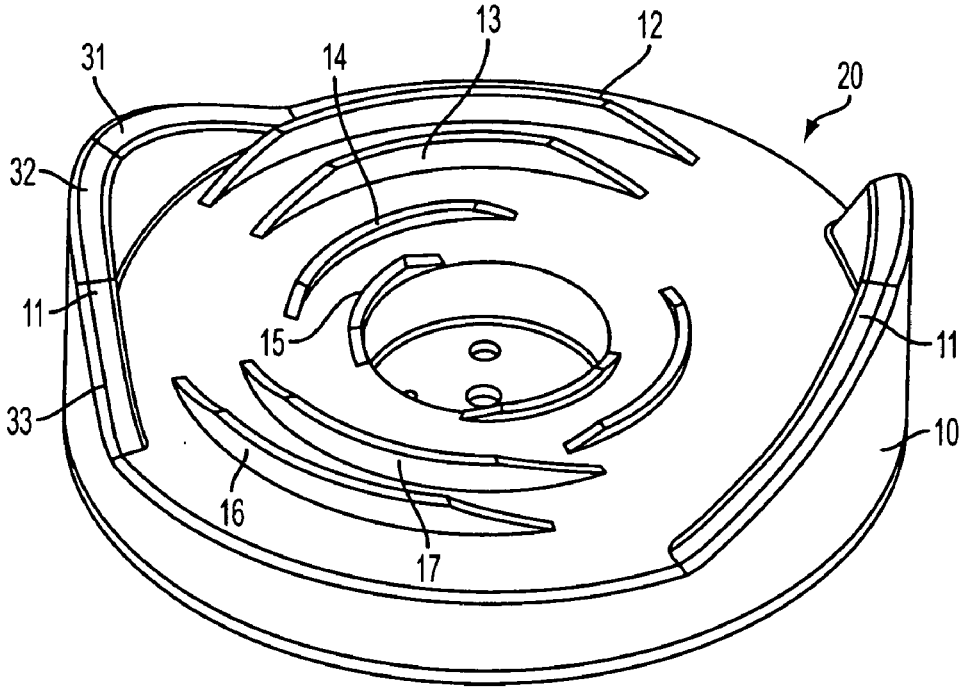
FIG. 2 is an enlarged perspective view of the cam disc of FIG. 1.

FIG. 2 shows the cam disc 10 with an example implementation of the control means. The invention is based, among other things, on the realization that, in the case of a cost-effective and simple apparatus for the production of air cushions, it is more advantageous not to use an electronic control since a number of high-wattage elements must be actuated here, which leads to correspondingly expensive solutions. With the cam disc disposed in parallel with the film plane, it is possible to arrange on it guide ribs 11 that control, on one hand, the mechanical process of cutting, and on the other hand press the elements required for the welding operation in the form of stamps against the matrix and lastly carry out and control, as an on-off switch, the electrical functions. It should be pointed out, however, that the blower that is required to fill the air cushions with air advantageously remains powered on continuously while the apparatus is running, so that the main on-switch is at the same time also the on-switch for the blower. However, it would be possible in principle, to also provide a corresponding guide rib on the cam disc 10 for the actuation control of the blower, so that it is active only during the corresponding steps. The elements listed in connection with FIGS. 3 through 6 have, for example, transmitting elements, on whose lower ends a roller is provided that rolls over the disc 10 and the ribs.

Figure 3:
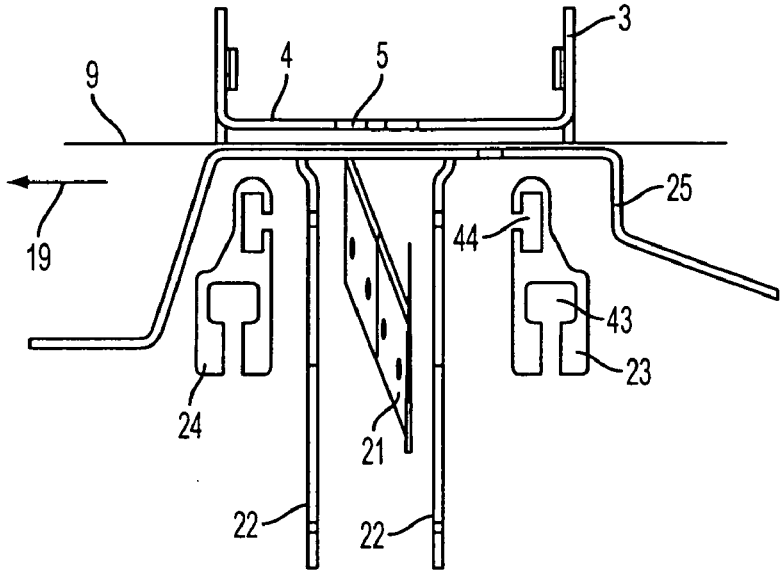
FIG. 3 is a very schematic partial side view of the functional elements of the apparatus in the off-position.

The guide ribs are specifically as follows: Marked with the reference numeral 11 are the uppermost guide ribs whereby the cutting blade marked with the reference numeral 21 in FIGS. 3 through 7 is controlled. The reason being that this cutting blade 21 is lifted the farthest from a deep off-position, which is shown in FIG. 3, into the cutting position according to FIG. 5, as it must, coming from a region below the film 9, completely separate the same in a region in the middle. It is pointed out that, according to a preferred embodiment, the two layers of the film are merely perforated in their side regions (slit 6 according to FIG. 1), in order to create a linked series of air cushion chambers that can, in the individual case, be torn off separately from one another.

In a starting position, which may be marked by the arrow 20, for example, all processing elements of FIG. 3 are in the off-position. These are the above-mentioned blade 21, shown here schematically, between guide means 22, a first welder terminal 23, and a second welder terminal 24. At the time the power is switched on, the welder terminals are heated to operating temperature. The film tube, or simply tube 9, which is still open, is advanced in the direction of the arrow 19. The tube 9 travels on a base area 24 of the apparatus, which is disposed opposite the blower terminal 3, which comprises a bottom area serving as matrix 4 and including in its center the slit 5. The cutting blade 21 associated with the slit 5 has, for example, a width ⅔ of the width of the film and it is curved in a U shape or V shape. It may also extend as a perforation blade into the edge regions of the film. The tip of the U shape or V shape is oriented in the direction 19 of the film advancement and is thus positioned in the direction of the airflow blown in from the blower. It is essential that the slit that is creatable by the cutting blade 21 is aligned in the filling direction of the air cushions, meaning that, in its central region the opening faces away from the blower and toward the air cushion. The cutting means 21 therefore has a tapered or arrow shape, with the tip of the shape pointing away from the blower in the direction of the packaging air cushion to be filled.

From the off-position marked with the reference numeral 20 in FIG. 2, the disc 10 rotates in a clockwise direction, so that the guide ribs 12 and 13 come into engagement first.

Figure 4:
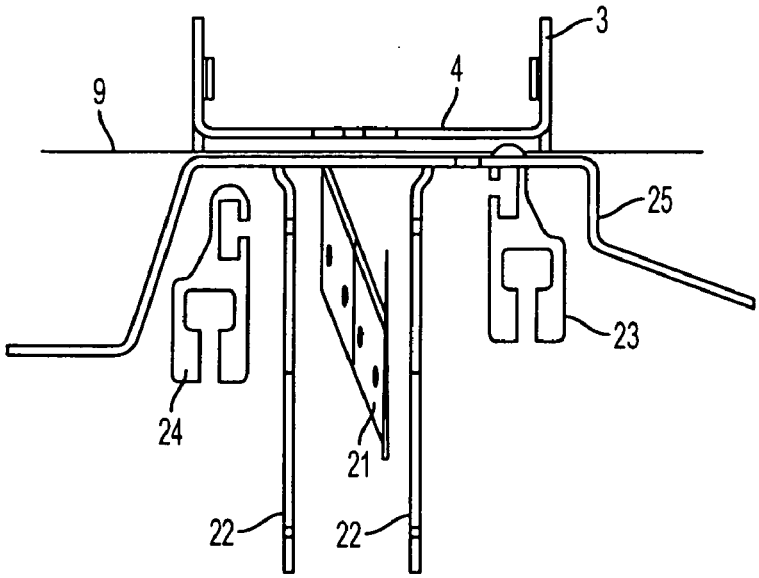
FIG. 4 is a very schematic partial side view of the functional elements of the apparatus during the first welding step.

In the process, according to the illustration in FIG. 4, the rear welder terminal 23, as viewed in the direction of movement of the film 9, is raised by a bar that extends into the hollow space 43 and that is supported on the opposite side on said rib 12. With the heatable upper end of the welder terminal 23, for example by means of heating elements installed in the hollow space 44 in the welder terminal 23, the doubled up film tube 9 is welded shut in the region between the welder terminal 23 and matrix 4 of the welder terminal 3. The duration of the welding process may be a few tenths of a second. The matrix 4 is preferably non-stick coated, for example Teflon-coated. The rib 13, in the process, actuates elements not visible in FIG. 4 that protect the film 9 from shifting. In FIG. 4, the terminal 23 also appears to have been drawn extending through the film 9; this corresponds to the schematic illustration; in reality, the element pushes the two film layers against the surface 4. The film tube that has been welded shut in one area is subsequently advanced, so that the weld seam according to FIG. 5 is located, for example, in the region 39.

Figure 5:
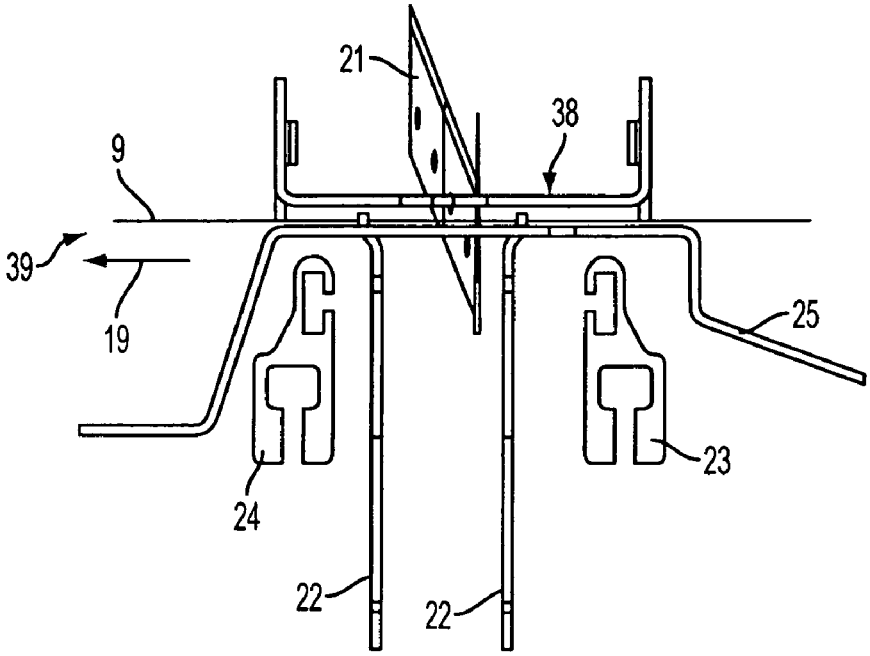
FIG. 5 is a very schematic partial side view of the functional elements during the cutting operation.

A guide tappet that is not shown in the drawings engages into the guide rib 11 already in the region of the sloping flank of the guide ribs 12 and 13, and in this manner moves the cutting blade 21 to the separation of the film 9, as it is illustrated schematically in FIG. 5. At the same time, the lateral guide means 22 are raised as pressure terminals by the guide ribs 14 and 15. The rear pressure terminal 22, as viewed in the direction of movement, is raised first by the guide rib 14. The cutting blade 21 and the pressure terminal 22 are subsequently moved back. The air that is supplied by means of the blower, for example in the region 38, can then enter through the produced slit into the bag and fill it, since the film tube 9 is closed, in addition to its sides, also in the region 39. When the bag is sufficiently filled, which may be achieved through an appropriately timed inflation time, or also be measured by means of a sensor, the apparatus transitions into the state shown in FIG. 6.

Figure 6:
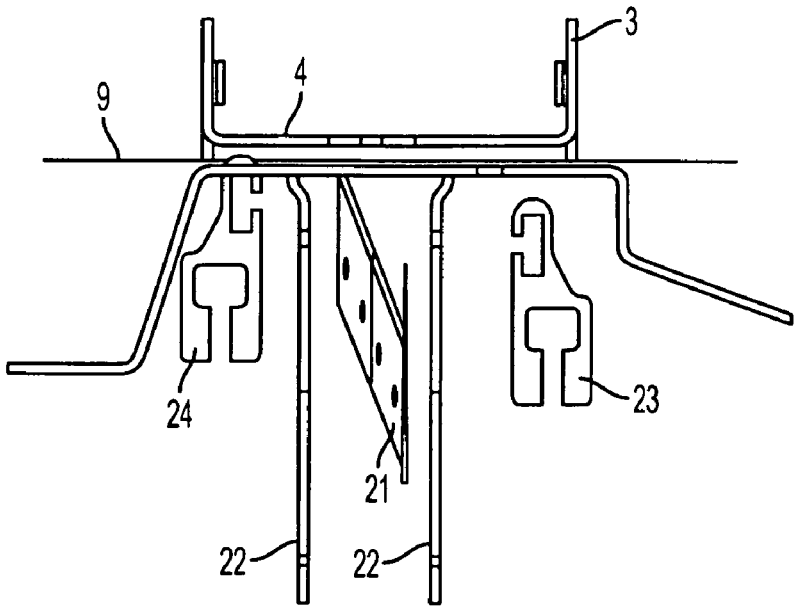
FIG. 6 is a very schematic partial side view of the functional elements of the apparatus during the second welding step.

Then, as shown in FIG. 6, the front welder terminal 24, as viewed in the direction of movement of the film 9, is pushed against the underside 4 of the blower terminal 3 by the guide ribs 16 and 17 in order to weld shut the film 9 a second time.

Since, as previously mentioned, the blower is advantageously powered on for the entire duration of the operating steps, filling of the air cushion takes place as follows: In the step before FIG. 3, the last produced air cushion is transported out of the apparatus, which is accomplished by the first motor, which is connected to the rollers. Then the film portion located in the direction of the supply roll 1 is welded shut crosswise (FIG. 4).

Afterwards, the perforation and the air supply opening are cut into the film by means of the blade 21, so that starting at this time, the air volume supplied by the blower can flow between the two layers of the film 9 and inflate it in the direction of movement 19, outside the apparatus. In the process, a bag is created, since the weld seam produced by the previous cycle by means of the welder terminal 23 seals the tube toward the front in the region 39. In the simplest case it is therefore necessary to have the blower blow starting only from the step shown in FIG. 5 through completion of the step shown in FIG. 6.

In the next step, according to FIG. 6, the air bag that is located outside the apparatus—while being held fully inflated by the blower—is then sealed in its entirety through the application of the second welder terminal 24. In a step between FIG. 6 and FIG. 3, the film material is subsequently advanced by the first motor by the length of one film bag. It is possible to provide a corresponding adjusting means for this process so that the user himself can determine the length of the film bag he is producing.

Preferably before or after the advancement of the bag, the cutting blade 21 moves onto the second guide rib 11. This results in a second assumption of the cutting position, with the difference that this position is a stop position in which the blower terminal can be folded up. The blade can thus be exchanged here, since it projects upward through the surface 25. It should be noted that this removal position is not identical with the idle position marked with the reference numeral 20, in which the user can exchange the roll.

The ribs 11 through 16 each have an ascending flank 31 drawn in by way of example at a guide rib 11, a plateau region 32, and a descending flank 33. It is obvious that during the cutting process, the effect already sets in on the ascending flank 31, when the blade 21 successively cuts through the double-layered films. For the other steps, the ascending flanks serve for moving and creating a contact pressure, with the actual welding function being carried out, for example, in the plateau phase. In the case of the electrical switching effect exerted by the rib, for example rib 14, the switching-on is effected by the ascending flank; the plateau phase corresponds to the on-time and the welding elements are switched back off during the descending flank. In principle, the cycle rate is adjustable through the number of revolutions of the disc 10 via the rate of revolutions of the second motor driving this disc, although a permanently preset mode is preferred for reasons of simplicity.

The apparatus may also be supplied, in lieu of a film tube, with two individual films sitting on top of each another in the apparatus, if heating elements are provided at the edges in the direction of movement 19 on the left and right in each case that continually operate during the conveyance; these may be disposed, for example, on the rollers 2 and produce, in this manner, a film tube from the two individual films.

When the blower terminal is folded up, lift-out rods are actuated that release the tension on the rollers 2 and 7, so that the film can then also be inserted between these rollers.

The sequence of the steps according to FIGS. 3 through 6 may also be performed differently. In a first step, the welding is performed according to FIG. 4. The film 9 is then advanced through the action of the first motor. Afterwards the film is cut while being held by the guide means 22 as illustrated in FIG. 5. Afterwards the other weld seam is immediately placed, according to FIG. 6, without additional advancement.

A device that is marked in FIG. 1 with the reference numeral 40 is advantageously disposed on the shaft of the roll 1. The film rolls 1 are preferably coded, for example by means of an induction-based chip or barcode applied on the shaft, or by means of the shape of the hub of the roll, etc. In this manner, the type of roll, for example the film thickness, can be conveyed to the correspondingly implemented reader device 40. This information is then transmitted directly to the control means of the second motor for driving the cam disc, which, in dependence upon the required weld times (preheating times) adjusts the speed of rotation of the cam disc 10 and, hence, the weld time.

Figure 7:
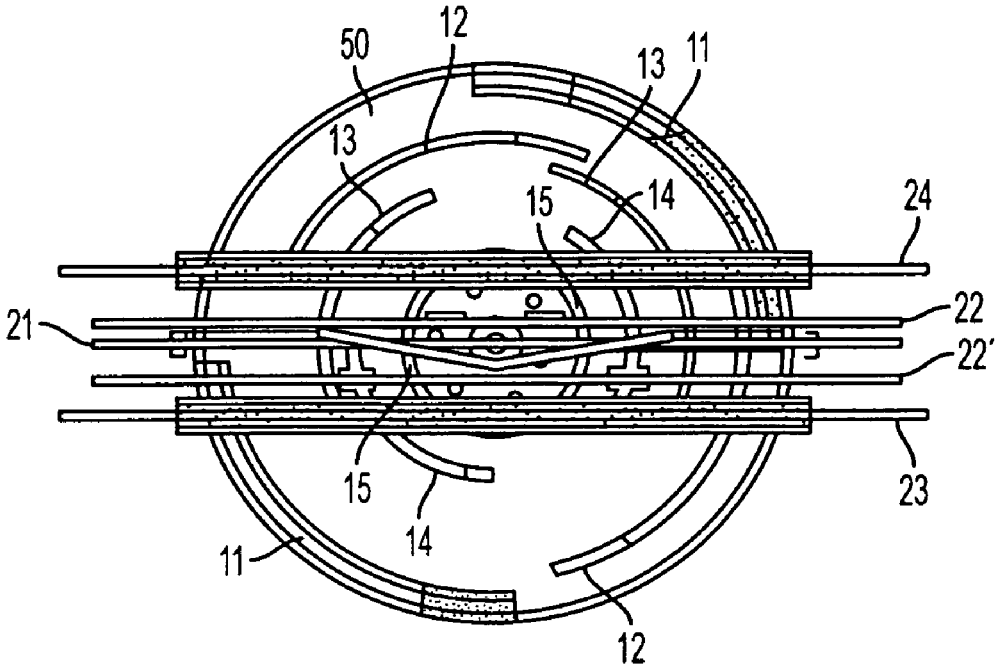
FIG. 7 is a schematic side view of some of the functional elements of the apparatus according to an additional example embodiment in the off-position.
Figure 8:
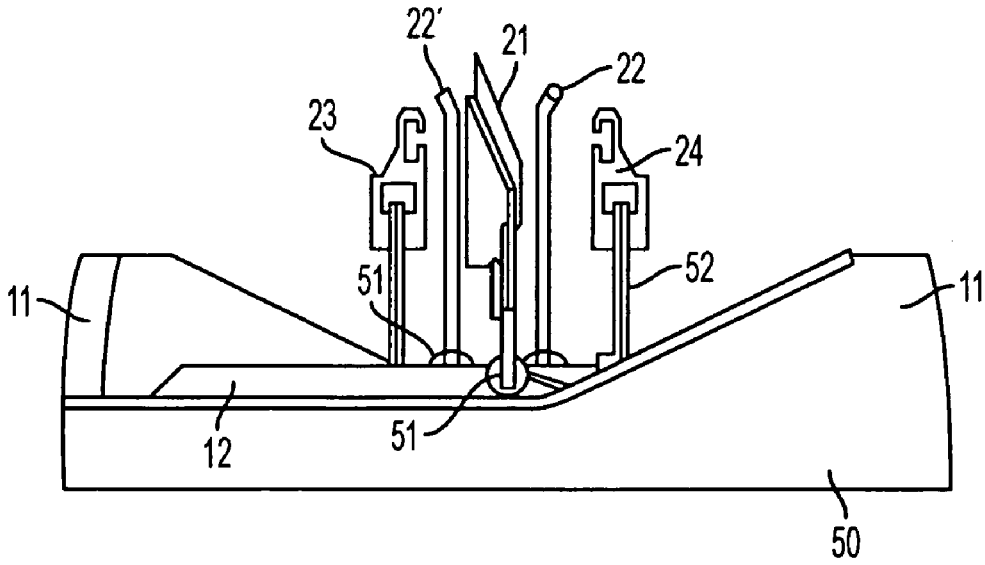
FIG. 8 is a plan view on the apparatus according to FIG. 7.

FIG. 7 shows a schematic side view of some of the functional elements of the apparatus according to a further example embodiment in the off-position, and FIG. 8 shows a matching plan view of this apparatus.

The coulisse-type disc 50 performs, per bag being produced, a full rotation of 360 degrees. The ribs and functional elements work together as follows. In the process, wheels 51 roll up onto the flattened ribs and the movement of the functional elements is transmitted via the links 52 that connect a wheel 51 in each case to a functional element 21, 22, 22', 23 or 24. The functional elements may particularly always make contact on the coulisse-type disc 50 on two sides by means of two links 52 with two wheels 51, so that all functional elements are guided on two sides.

First, the bag is closed with [1] in the example embodiment of FIGS. 7 and 8 by means of the welder terminal 24, in such a way that the welder terminal 24 travels over the associated ribs 12. The reference numerals in FIGS. 7 and 8 denote the same elements. Their sequence of application may differ from the example embodiment of the other figures.

The film 9 is moved into position and held in position by the holders 22 and 22' through the rib pairs 15 and 14, so that it does not shift during the subsequent cutting process. The cutting process takes place by means of the blade 21 and ribs 11.

The welder terminal 23 then welds shut the air-filled bag by moving up onto the ribs 13, since the passing-through blower has supplied air into the half-formed bag after the cutting operation. In the embodiment according to FIGS. 7 and 9, the blade 21 subsequently passes once more through the already slit location of the film before a new cycle begins.

What is claimed is:

1. An apparatus for producing packaging air-cushion elements having at least one supply roll (1) of laminatable plastic film material (9) that is feedable in at least one length to the apparatus (2, 7), comprising a cutting means (21) for cutting at least one opening into the plastic film material (9), which is double-layered in the apparatus, comprising a blower whereby air is blowable through said opening into the plastic film material (9), and comprising closing means (23, 24) for creating a sealed air cushion from the plastic film material (9), characterized in that a cam disc (10) is provided on which a series of raised guide means (11, 12, 13, 14, 15, 16) are provided that are in direct actuation contact with the cutting means (21) and with the closing means (23, 24).

2. An apparatus according to claim 1, characterized in that the cam disc (10) is oriented parallel to the plane of the double-layered plastic film material in the apparatus, that the raised guide means (11, 12, 13, 14, 15, 16) on the cam disc (10) are ribs on which rollers roll off that are connected to the cutting means (21) and to the closing means (23, 24).

3. An apparatus according to claim 1 or 2, characterized in that two motors are provided, that the first motor drives the cam disc (10) and that, independently from this, the second motor drives feeding rollers (2, 7) for establishing the length of the film material (9).

4. An apparatus according to any of claims 1 through 3, characterized in that the film material roll (1) has an identification element, which is readable by a detector in order to control the speed of rotation of the cam disc.

5. An apparatus for producing packaging air-cushion elements, having at least one supply roll (1) of laminatable plastic film material (9) that is feedable in at least one length to the apparatus, comprising a cutting means (21) for cutting at least one opening into the plastic film material (9), which is double-layered in the apparatus, comprising a blower whereby air is blowable through said opening into the plastic film material (9), and comprising closing means (23, 24) for creating a sealed air cushion from the plastic film material (9), characterized in that the cutting means (21) has a tapered or arrow shape in such a way that the tip of the shape is oriented facing away from the blower in the direction of the air blowing into the opening of the plastic material.

6. An apparatus according to claim 5, characterized in that the tapered shape or arrow shape of the cutting means (21) is a V shape, U shape, or C shape.

* * * * *